United States Patent [19]

Anderson

[11] 4,411,717

[45] Oct. 25, 1983

[54] SOLID ROCKET PROPELLANTS COMPRISING GUIGNET'S GREEN PIGMENT

[75] Inventor: William S. Anderson, Sunnyvale, Calif.

[73] Assignee: The United States of America as represented by the Secretary of the Air Force, Washington, D.C.

[21] Appl. No.: 463,190

[22] Filed: Feb. 2, 1983

[51] Int. Cl.[3] ..... C06B 45/06

[52] U.S. Cl. ..... 149/18; 149/19.4; 149/19.9; 149/20; 149/76; 149/86

[58] Field of Search ..... 149/18, 19.4, 19.9, 149/76, 20, 86

[56] References Cited

U.S. PATENT DOCUMENTS

| | | | |
|---|---|---|---|
| 2,740,702 | 4/1956 | Mace | 52/0.5 |
| 3,151,010 | 9/1964 | Bize | 149/19.9 |
| 3,259,531 | 7/1966 | Lofberg | 149/19.9 |
| 3,664,898 | 5/1972 | Taylor et al. | 149/41 |
| 3,748,199 | 7/1973 | Vriesen et al. | 149/19 |
| 3,830,675 | 8/1974 | Zelinski et al. | 149/19.9 |
| 3,948,698 | 4/1976 | Elrick et al. | 149/19.9 |

*Primary Examiner*—Edward A. Miller

*Attorney, Agent, or Firm*—Donald J. Singer; Charles E. Bricker

[57] ABSTRACT

A solid rocket propellant composition comprising a major amount of ammonium perchlorate, a minor amount of aluminum powder, a minor amount of a binder, and an effective, burn rate modifying amount of Guignet's green pigment or oxidized Guignet's green. Guignet's green pigment increases the burn rate of the propellant without unacceptably increasing the pressure dependence of the burn rate.

8 Claims, No Drawings

SOLID ROCKET PROPELLANTS COMPRISING GUIGNET'S GREEN PIGMENT

RIGHTS OF THE GOVERNMENT

The invention described herein may be manufactured and used by or for the Government of the United States for all governmental purposes without the payment of any royalty.

BACKGROUND OF THE INVENTION

This invention relates to solid propellants, and in particular, to burn rate catalysts for solid propellants.

It is a common practice to use solid or plastic propellant mixtures in the combustion chambers of rocket motors. Such propellants are burned to produce gaseous combustion products which are exhausted through a nozzle at high velocity, thereby producing a thrust. The burning rate of solid propellants affects the amount of thrust obtained per unit of given cross section, the thrust developed being dependent upon the volume of gases liberated per unit time.

A solid rocket propellant comprising a major amount of ammonium perchlorate, a minor amount of aluminum powder and a minor amount of a hydroxy-terminated polybutadiene binder, for example, will burn with relative freedom from smoke, but may not develop a desired level of thrust. Several substances have been added to solid propellants to accelerate the burning rate to a desired level. Well known examples of burn rate modifiers or catalysts are ferric oxide, ferric fluoride, copper chromite, ferrocene and certain derivatives thereof, and vanadium pentoxide. Each of these catalysts has one or more drawbacks. The iron salts may interfere with propellant mixing and cure; copper chromite may catalyze oxidation of the binder at room temperature. The ferrocenes tend to migrate out of the propellant while in storage. Vanadium pentoxide presents health hazards to workers during propellant formulation, casting and curing. Certain burn rate catalysts which, while increasing the burning rate somewhat, incidentally make the propellant composition sensitive to shock, thereby creating an explosion hazard.

U.S. Pat. No. 3,740,702, issued Apr. 3, 1956, to Harry W. Mace, discloses an ammonium perchlorate-asphalt type of propellant catalyzed with chromium sesquioxide ($Cr_2O_3$), ferrosoferric oxide, or a mixture of $Cr_2O_3$ with an oxide taken from the group of metal oxides consisting of ZnO, $Fe_2O_4$, $TiO_2$, $SnO_2$, $Al_2O_3$ and CuO. There is no disclosure of the use of $Cr_2O_3$ in a propellant composition comprising ammonium perchlorate, aluminum powder and a hydroxy-terminated polybutadiene.

I have discovered that Guignet's green pigment is superior to chromium sesquioxide as a burn rate catalyst in a propellant composition comprising ammonium perchlorate, aluminum powder and hydroxy-terminated polybutadiene. I have further discovered that oxidized Guignet's green pigment is an effective low-pressure burn rate catalyst.

Accordingly, it is an object of the present invention to provide an improved solid rocket propellant composition.

Other objects and advantages of the present invention will become apparent to those skilled in the art from a reading of the following description of the invention.

DESCRIPTION OF THE INVENTION

In accordance with the present invention there is provided an improved solid rocket propellant composition comprising a major amount of ammonium perchlorate, a minor amount of aluminum powder, a minor amount of hydroxy-terminated polybutadiene and an effective burn rate modifying amount of Guignet's green pigment. There is also provided an improved solid rocket composition comprising oxidized Guignet's green pigment.

Guignet's green pigment, known variously as hydrated chromium oxide, chromium hydrate green, pigment green 18, Vert Emeraude, chromium hydrate and viridian, is a commercially available pigment widely used in cosmetics, toiletries, paints, enamels and lacquers. It has been described chemically as $Cr_2O_3.2H_2O$, as $Cr_2O_3.4H_2O$, as $Cr_2O(OH)$ and as $Cr_2O(OH)_4$. It is prepared commercially by calcining an alkali metal dichromate, such as potassium dichromate, with boric acid, then washing the calcination product with water to leave a very finely divided, intensely green, acid- and base-resistant, nontoxic, boron-poor pigment.

Small particle size is one distinguishing feature of Guignet's green. The commercial pigment consists, in large part, of particles having an average diameter of less than one micron. This particle size is well below that of the average calcined metal oxide pigment.

Another distinguishing feature of Guignet's green pigment is seen in the behavior of suspensions of the pigment in aqueous hydrogen peroxide. The evaluation of oxygen gas begins immediately and continues for several minutes when 30% hydrogen peroxide and Guignet's green are mixed at room temperature. The supernatant liquid soon acquires the yellow color characteristic of hexavalent chromium ion. In contrast, crystalline chromium sesquioxide, although it does promote the decomposition of hydrogen peroxide, does not release hexavalent chromium ions in the process. Guignet's green is resistant to attack by acids and bases. Aqueous solutions of perchloric acid or ammonium perchlorate do not dissolve the pigment even at 50°–60° C. Such resistance indicates that ammonium perchlorate-based propellants containing Guignet's green pigment will not generate ammonia even on long aging in moist environments.

Like other transition metal oxides, Guignet's green is hygroscopic. The commercial pigment generally contains volatile, loosely bound water that could interfere to some degree with the isocyanate-induced cure of hydroxy-terminated polybutadiene propellant binders. It is therefore preferred that the Guignet's green pigment be dried prior to its use, such as by heating under reduced pressure at about 70° C. for about 1 to 10 hours.

Guignet's green pigment may be converted to a black, oxidized form by heating the pigment in an atmosphere of pure oxygen, preferably a flowing stream of oxygen, to about 350° C. for about 10–60 minutes.

Guignet's green may be added to an ammonium perchlorate-based solid propellant formulation in an effective burn rate modifying amount. Depending upon the propellant recipe and the degree of modification desired, this effective amount will range from about 0.25 to about 5.0 weight percent, based upon the weight of the total formulation, preferably about 0.50 to 1.50 weight percent. The black, oxidized Guignet's green pigment is added to the propellant recipe in the amounts given above.

In addition to the ammonium perchlorate oxidizer and the Guignet's green burn rate modifier, the solid propellant may contain a polymeric fuel binder, such as hydroxy-terminated polybutadiene (HTPB), curatives, bonding agents, stabilizers, metals such as aluminum, and the like.

The following examples illustrate the invention.

EXAMPLE I

The efficacy of Guignet's green (hydrated chromium oxide pigment) as a combustion catalyst was demonstrated by applying 0.1 gram of the pigment to the surface of a pressed cake of wood pulp and paraffin wax. ("Firestix" fire starters for charcoal briquettes, manufactured by Fire Stix, San Diego, CA) A red-hot glass rod was touched to the pigment particles to initiate combustion. Once combustion started, the particles of pigment supported on the fuel cake continued to glow brightly for several minutes, eventually buring a pathway through the fuel cake.

In contrast, nonhydrated chromium sesquioxide was inert to this test. The particles could not be brought to incandescence and the nonhydrated oxide did not accelerate regression of the fuel cake surface. Furthermore, when the Guignet's green pigment was first heated to red heat for several minutes in a crucible to convert it to nonhydrated, well annealed chromium sesquioxide, the pigment lost its catalytic activity completely and performed, in the above-described test, as poorly as the commercial, nonhydrated chromium sesquioxide.

EXAMPLE II

A series of propellant formulations using different burn rate modifiers were prepared according to the following recipe:

| Component | Wt. % |
|---|---|
| Ammonium perchlorate | 70.0 |
| Aluminum powder | 17.0 |
| HTPB | 8.51 |
| Isodecyl pelargonate | 2.50 |
| Bonding Agent | 0.30 |
| Stabilizer | 0.10 |
| Isophorone diisocyanate | 0.59 |
| Burn rate modifier | 1.00 |

Each propellant formulation was mixed, cast into a test rocket engine and cured in accordance with procedures well known in the art. The test engines were fired and the burn rate, in inches per second, at 1000 psi chamber pressure and the pressure exponent, n, were determined. The pressure dependence of the burn rate of solid propellants is expressed as burn rate=burn rate at 1000 psi×(chamber pressure in psi/1000 psi)$^n$. The results of the test firings are given in Table I.

TABLE I

| Burn Rate Modifier | Burn Rate | Pressure Exponent |
|---|---|---|
| None | 0.55 | 0.52 |
| Guignet's green | 1.22 | 0.44 |
| Chromium Sesquioxide | 0.93 | 0.38 |
| Catocene[a] | 1.23 | 0.28 |
| Chromium chromate | 0.77 | 0.77 |
| Copper chromate | 1.14 | 0.51 |
| Zinc chromate | 0.80 | 0.41 |
| Chromium dioxide ($CrO_2$) | 1.13 | 0.34 |
| Pyrolyzed $CrO_3$ ($CrO_{2.3}$) | 0.90 | 0.40 |
| Ferric oxide | 1.03 | 0.52 |

TABLE I-continued

| Burn Rate Modifier | Burn Rate | Pressure Exponent |
|---|---|---|
| Copper chromite | 1.00 | 0.36 |

[a]A liquid, ferrocene-based burn rate modifier, available commercially from Arapahoe Chemicals, Inc., Boulder, Colorado.

The above data illustrate that Guignet's green increases the burn rate of the propellant by a large factor without simultaneously and unacceptably increasing the pressure dependence, i.e., the pressure exponent, of the burn rate. In this respect, Guignet's green is superior to the widely used ferric oxide burn rate modifier. It can also be seen that Guignet's green increases the burn rate as well as an equal amount of Catocene, the best available liquid, ferrocene-based burn rate modifier. Being a solid material which is insoluble in the HTPB binder, the Guignet's green will not migrate out of the propellant during storage as do ferrocene derivatives.

EXAMPLE III

A series of test samples were prepared by incorporating 1 weight percent of certain of the above-named burn rate modifiers into HTPB (which contained 0.1% antioxidant). Each of the samples was spread into a glass microscope slide for a film thickness of 5 to 15 mils. The slides were placed in a circulating air oven at 80° C. and the time required for each film to harden was noted. The rate of hardening of these thin films in air is given in Table II.

TABLE II

| Burn Rate Modifier | Time to harden, days |
|---|---|
| None | >11 |
| Guignet's green | 10 |
| Chromium sesquioxide | >11 |
| Catocene | 5 |
| Chromium Chromate | 9 |
| Copper chromate | 2 |
| Chromium dioxide | 5 |
| Pyrolyzed $CrO_3$ | 9 |
| Ferric oxide | 11 |

The above data illustrates that Guignet's green has little effect on the rate of oxidation of the hydroxy-terminated butadiene at storage temperatures. Accordingly, the Guignet's green should not appreciably shorten the service life of solid propellant.

EXAMPLE IV

Guignet's green pigment was converted to a black, oxidized form by heating for one hour in a current of pure oxygen at 350° C. The oxidized pigment is particularly effective as a burn rate modifier at low pressures. When formulated into the recipe given in Example II, the oxidized Guignet's green produced a burning rate pressure exponent, n, of 0.34 over the region 250 to 1800 psi.

Various modifications may be made in the present invention without departing from the spirit thereof or the scope of the following claims.

I claim:

1. In a solid rocket propellant formulation comprising a major amount of ammonium perchlorate, a minor amount of aluminum powder, and a minor amount of a binder material, the improvement which comprises an effective burn rate improving amount of Guignet's green pigment.

2. The propellant formulation of claim 1 wherein said effective amount is in the approximate range of 0.25 to 5.0 weight percent.

3. The propellant formulation of claim 2 wherein said effective amount is in the approximate range of 0.50 to 1.50 weight percent.

4. The propellant formulation of claim 3 wherein said effective amount is 1.0 weight percent.

5. In a solid rocket propellant formulation comprising a major amount of ammonium perchlorate, a minor amount of aluminum powder, and a minor amount of a binder material, the improvement which comprises an effective burn rate improving amount of oxidized Guignet's green pigment, prepared by heating Guignet's green pigment in the presence of oxygen at about 350° C. for about 10–60 minutes.

6. The propellant formulation of claim 5 wherein said effective amount is about 0.25 to 5.0 weight percent.

7. The propellant formulation of claim 6 wherein said effective amount is about 0.50 to 1.50 weight percent.

8. The propellant formulation of claim 7 wherein said effective amount is about 1.0 weight percent.

* * * * *